US011350694B1

(12) United States Patent
Montross et al.

(10) Patent No.: US 11,350,694 B1
(45) Date of Patent: Jun. 7, 2022

(54) ARTICLE OF FOOTWEAR COMPRISING DANDELION FOAM LATEX MATERIALS

(71) Applicant: Cole Haan LLC, Greenland, NH (US)

(72) Inventors: Matthew Montross, Greenland, NH (US); Xiao Jun, Dongguan (CN)

(73) Assignee: COLE HAAN LLC, Greenland, NH (US)

( * ) Notice: Subject to any disclaimer, the term of this patent is extended or adjusted under 35 U.S.C. 154(b) by 0 days.

(21) Appl. No.: 17/527,306

(22) Filed: Nov. 16, 2021

Related U.S. Application Data

(60) Provisional application No. 63/237,877, filed on Aug. 27, 2021.

(51) Int. Cl.

| | |
|---|---|
| ***C08J 9/12*** | (2006.01) |
| ***A43B 13/12*** | (2006.01) |
| ***A43B 13/04*** | (2006.01) |
| ***A43B 13/18*** | (2006.01) |

(52) U.S. Cl.
CPC ..... *A43B 13/04* (2013.01); *A43B 13/187* (2013.01)

(58) Field of Classification Search
None
See application file for complete search history.

(56) References Cited

U.S. PATENT DOCUMENTS

| | | | | |
|---|---|---|---|---|
| 6,818,676 | B2 | 11/2004 | Koffler et al. | |
| 9,346,924 | B2 | 5/2016 | Wade et al. | |
| 9,611,363 | B2 | 4/2017 | Swiger et al. | |
| 9,681,757 | B2 * | 6/2017 | Svensrud | A47C 27/14 |
| 10,184,029 | B2 | 1/2019 | Swiger et al. | |
| 10,584,185 | B2 | 3/2020 | Nocera, Jr. et al. | |
| 2003/0182820 | A1 * | 10/2003 | Fuerst | A43B 1/0027 36/11.5 |
| 2010/0251565 | A1 * | 10/2010 | Litchfield | A43B 13/203 36/35 B |
| 2011/0016635 | A1 * | 1/2011 | Svensrud | A47C 27/14 5/724 |
| 2011/0275142 | A1 * | 11/2011 | Wade | A23L 29/30 536/123 |
| 2016/0135543 | A1 * | 5/2016 | Anceresi | A43B 23/0235 36/45 |
| 2019/0276626 | A1 * | 9/2019 | Baghdadi | A43B 1/14 |
| 2020/0275739 | A1 * | 9/2020 | Linkfield | A43B 9/16 |
| 2021/0079186 | A1 * | 3/2021 | Baghdadi | B29D 35/144 |

FOREIGN PATENT DOCUMENTS

| | | | |
|---|---|---|---|
| CN | 104865225 | A | 8/2015 |
| CN | 110628043 | A | 12/2019 |
| CN | 110643051 | A | 1/2020 |
| CN | 110885479 | A | 3/2020 |
| CN | 111443146 | A | 7/2020 |
| CN | 111808297 | A | 10/2020 |
| WO | 2002068515 | A1 | 9/2002 |

* cited by examiner

*Primary Examiner* — Jila M Mohandesi

(74) *Attorney, Agent, or Firm* — Thompson Coburn LLP

(57) ABSTRACT

An article of footwear comprising a sole and an upper on the sole. The sole comprises an insole, a midsole, and an outsole. At least one of the upper, insole, midsole, or outsole comprises a dandelion latex foam material.

30 Claims, 5 Drawing Sheets

ARTICLE OF FOOTWEAR COMPRISING DANDELION FOAM LATEX MATERIALS

CROSS-REFERENCE TO RELATED APPLICATIONS

This application claims the benefit of U.S. Provisional Application Ser. No. 63/237,877, filed Aug. 27, 2021, which is hereby incorporated by reference in its entirety.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to articles of footwear comprising dandelion foam latex materials.

SUMMARY

One aspect of the disclosure is an article of footwear comprising a sole and an upper on the sole. The sole has a sole heel end and a sole toe end. The sole extends longitudinally from the sole heel end to the sole toe end. The sole has a lateral side extending longitudinally from the sole heel end to the sole toe end and a medial side extending longitudinally from the sole heel end to the sole toe end. The sole extends transversely from the lateral side to the medial side. The sole includes a sole heel region, a sole midfoot region, a sole forefoot region, and a sole toe region. The sole heel region extends longitudinally from the sole heel end to the sole midfoot region. The sole midfoot region extends longitudinally from the sole heel region to the sole forefoot region. The sole forefoot region extends longitudinally from the sole midfoot region to the sole toe region. The sole toe region extends longitudinally from the sole forefoot region to the sole toe end. The sole comprises a dandelion latex material.

Another aspect of the disclosure is an article of footwear comprising a sole and an upper on the sole. The sole comprises a midsole and an outsole. The midsole is between the outsole and the upper. The midsole comprises a dandelion latex material. At least 20% of the dandelion latex foam material is a thermoplastic elastomer.

Yet another aspect of the disclosure is an article of footwear comprising a sole and an upper on the sole. The sole comprises an insole, a midsole, and an outsole. At least one of the upper, insole, midsole, or outsole comprises a dandelion latex foam material.

Further features and advantages, as well as the operation, are described in detail below with reference to the accompanying drawings.

Figure 1:
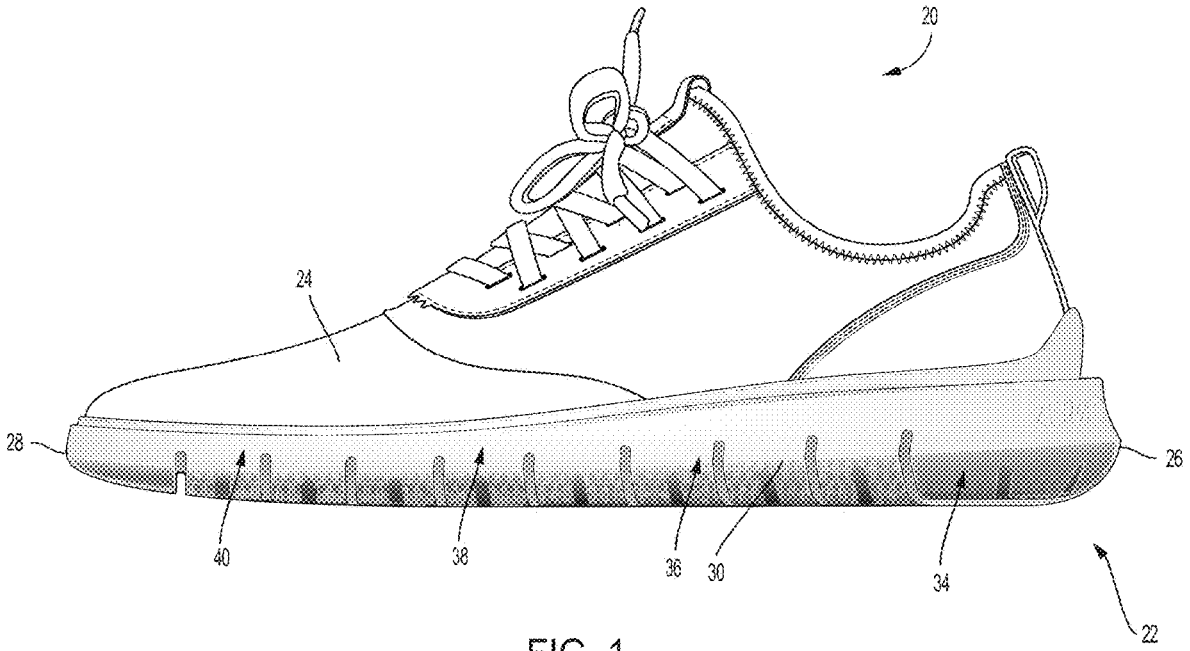
FIG. 1 is a perspective view of an embodiment of an article of footwear.

Reference numerals in the written specification and in the figures indicate corresponding items.

DETAILED DESCRIPTION

An embodiment of an article of footwear in accordance with the present disclosure is indicated generally by reference number 20. The article of footwear 20 comprises a sole, generally indicated by reference number 22, and an upper on the sole, generally indicated by reference number 24. The sole 24 has a sole heel end 26 and a sole toe end 28. The sole 22 extends longitudinally from the sole heel end 26 to the sole toe end 28. The sole 22 has a lateral side 30 extending longitudinally from the sole heel end 26 to the sole toe end 28, and a medial side 32 extending longitudinally from the sole heel end 26 to the sole toe end 28. The sole 22 extends transversely from the lateral side 30 to the medial side 32.

The sole 22 includes a sole heel region 34, a sole midfoot region 36, a sole forefoot region 38, and a sole toe region 40. The sole heel region 34 extends longitudinally from the sole heel end 26 to the sole midfoot region 36. The sole midfoot region 36 extends longitudinally from the sole heel region 34 to the sole forefoot region 38. The sole forefoot region 38 extends from the sole midfoot region 36 to the sole toe region 40. The sole toe region 40 extends longitudinally from the sole forefoot region 38 to the sole toe end 28.

The sole may comprise a dandelion latex foam material. As used herein, dandelion latex foam material refers to an elastic foam material that comprises dandelion latex. The dandelion latex foam material may additionally include other polymers (natural or synthetic), such as natural or synthetic rubber. The synthetic rubber may be a thermoplastic elastomer such as ethylene-vinyl acetate (EVA), thermoplastic polyurethane (TPU), or the like. Between 0% and 70% of the dandelion latex foam material may be a thermoplastic elastomer, with the remainder comprising dandelion latex or a combination of dandelion latex and other natural or synthetic polymers. For example, at least 10% of the dandelion latex foam material may be a thermoplastic polymer. As another example, at least 20% of the dandelion latex foam material may be a thermoplastic polymer. As a third example, at least 30% of the dandelion latex foam material may be a thermoplastic polymer. As a fourth example, at least 40% of the dandelion latex foam material may be a thermoplastic polymer. As a fifth example, at least 50% of the dandelion latex foam material may be a thermoplastic polymer.

Preferably, 20% to 80% of the dandelion latex foam material is dandelion latex, with the percentage varying based on the use case of the article of footwear 20. For example, dandelion latex foam material used for the midsole of an article of footwear may comprise a lower percentage of dandelion latex than the outsole of an article of footwear. It should be understood that the percentage of dandelion latex comprising the dandelion latex foam material is not limited to the 20% to 80% range, and that different percentages outside that range may be employed depending on the use case of the article of footwear 20 and the method of manufacturing employed. For example, different percentages of dandelion latex may be used in the dandelion latex foam material depending on whether injection molding or compression molding is employed.

Depending on the desired physical characteristics, the dandelion latex foam material may or may not be a cross-linked elastomer.

An advantage of the dandelion latex foam material is that it has a reduced carbon footprint when compared with conventional materials known in the art. For instance, use of the dandelion latex foam material recited herein may result in a $CO_2$ reduction as large as 3 kilograms per kilogram of material produced.

The upper 24 may also comprise a dandelion latex foam material.

The sole 22 may further comprise a midsole 42 and an outsole 44. The midsole 42 is between the outsole 44 and the upper 24. The midsole 42 may comprise a first dandelion latex foam material, and the outsole 44 may comprise a second dandelion latex foam material. The first dandelion latex foam material may be different from the second dandelion latex foam material. For example, the second dandelion latex foam material may be harder than the first dandelion latex foam material. The first dandelion latex foam material may have a specific gravity of 0.08 to 0.30 and a hardness of 25 to 90 asker C. The second dandelion latex foam material may have a specific gravity of 0.20 to 0.50 and a hardness of 30 asker C to 75 shore A.

Alternatively, the outsole 44 may comprise a dandelion latex non-foam material. As used herein, dandelion latex non-foam material refers to a non-foam material that comprises dandelion latex. The dandelion latex non-foam material may additionally include other polymers (natural or synthetic), such as natural or synthetic rubber. The dandelion latex non-foam material may have a hardness of 40 to 80 shore A, and a specific gravity of 0.5 to 1.3. Preferably, the dandelion latex non-foam material may have a hardness of 55 to 70 shore A, and a specific gravity of 0.8 to 1.3. Generally, the dandelion latex non-foam material is denser than the dandelion latex foam material. As yet another alternative, the outsole 44 may comprise both a dandelion latex non-foam material and a dandelion latex foam material.

The sole 22 may further comprise an insole 46. The insole 46 is above the midsole 42. The insole 46 may comprise a third dandelion latex foam material. The third dandelion latex foam material may be different from the first and second dandelion latex foam materials. For example, the first dandelion latex foam material may be harder than the third dandelion latex foam material. The third dandelion latex foam material may have a specific gravity of 0.08 to 0.20 and a hardness of 10 to 90 asker C.

The sole 22 of the article of footwear 20 may be of one piece unitary construction or may be of multiple components.

Figure 2:
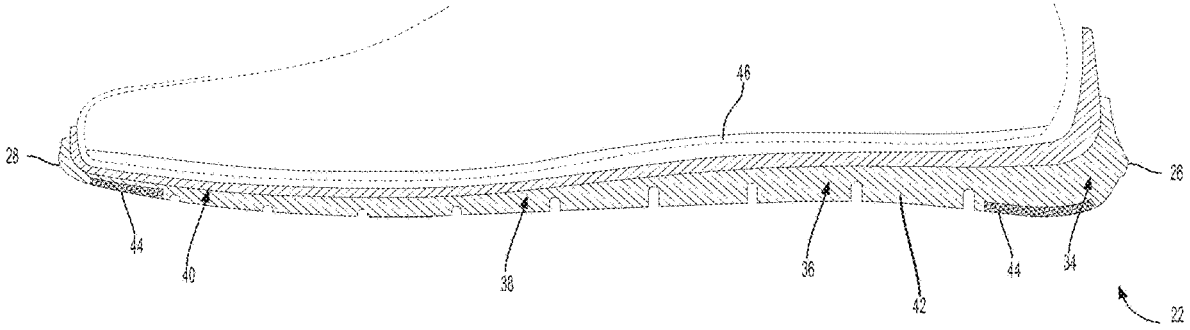
FIG. 2 is a section view of the article of footwear of FIG. 1 taken along the centerline of the article of footwear.
Figure 3:
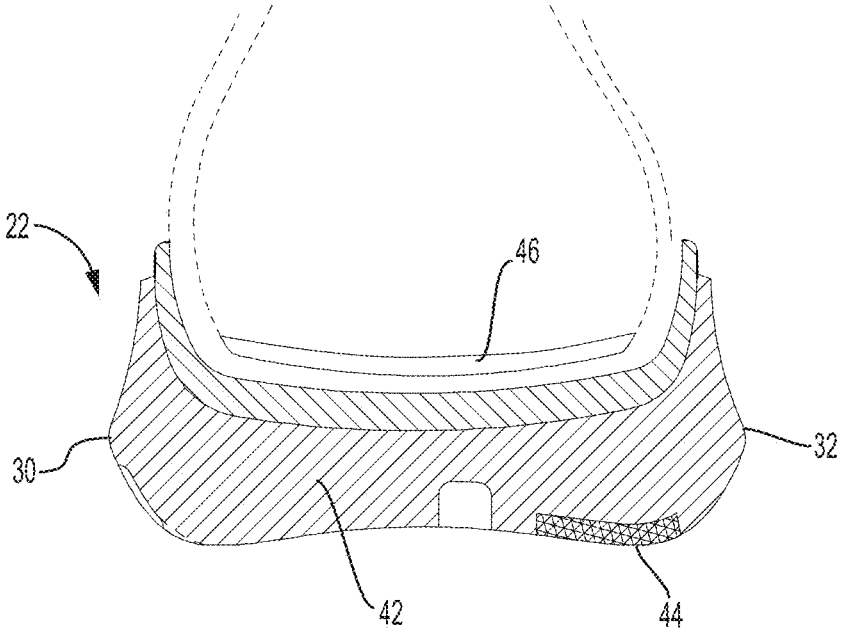
FIG. 3 is a section view of the article of footwear of FIG. 1 taken through the heel of the article of footwear.
Figure 4:
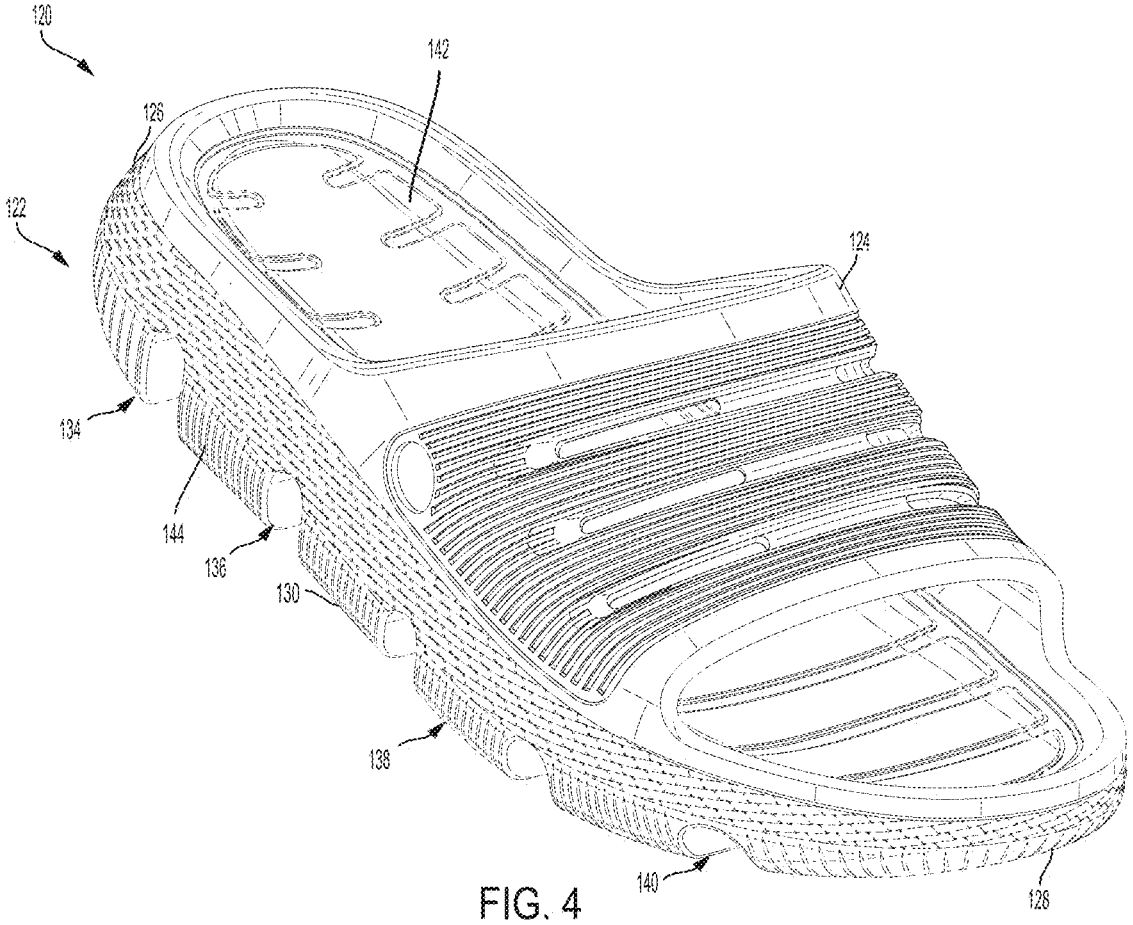
FIG. 4 is a perspective view of another embodiment of an article of footwear.
Figure 5:
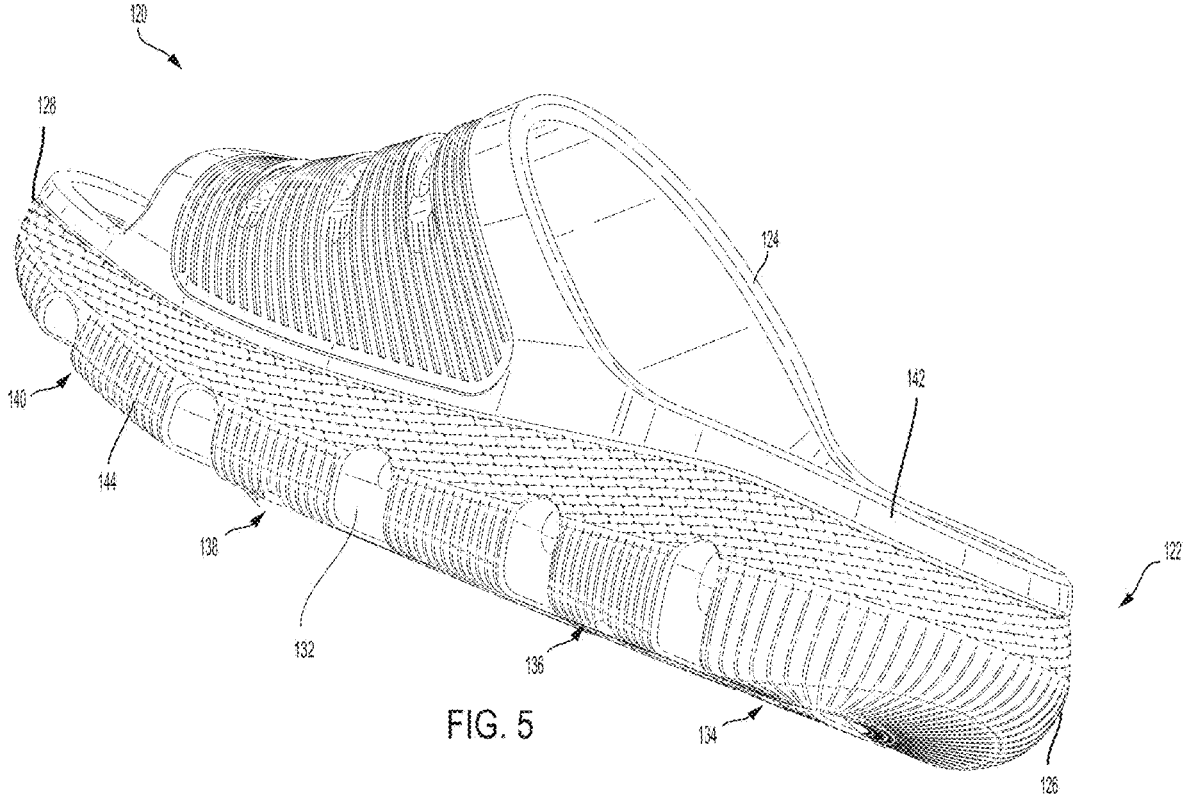
FIG. 5 is a perspective view of the article of footwear of FIG. 4.

Another embodiment of an article of footwear, indicated generally at 120, is shown in FIGS. 4-5. The above description of the article of footwear 20 of FIGS. 1-3 applies equally to the article of footwear 120 of FIGS. 4-5, except for the differences noted in the description of the embodiment of FIGS. 4-5 or as shown in the drawings of FIGS. 4-5. It is also to be understood that components, elements, features, or regions of the embodiment of FIGS. 4-5 have reference numbers corresponding to the reference numbers of the embodiment of FIGS. 1-3, except the reference numbers of the embodiment of FIGS. 4-5 include a prefix "1."

The article of footwear 120 has an upper 124, a midsole 142, and an outsole 144. The upper 124 is of one piece unitary construction with the midsole 142. The upper 124 and midsole 142 may comprise a first dandelion latex material, and the outsole 144 may comprise a second dandelion latex material. The first dandelion latex material may be a dandelion latex foam material. The second dandelion latex material may be a dandelion latex foam material. The second dandelion latex material may be harder than the first dandelion latex material. For example, the first dandelion latex foam material may have a specific gravity of 0.08 to 0.30 and a hardness of 25 to 90 asker C, and the second dandelion latex foam material may have a specific gravity of 0.20 to 0.50 and a hardness of 30 asker C to 75 shore A.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An article of footwear comprising:

a sole; and an upper on the sole;

the sole having a sole heel end and a sole toe end, the sole extending longitudinally from the sole heel end to the sole toe end, the sole having a lateral side extending longitudinally from the sole heel end to the sole toe end and a medial side extending longitudinally from the sole heel end to the sole toe end, the sole extending transversely from the lateral side to the medial side, the sole including a sole heel region, a sole midfoot region, a sole forefoot region, and a sole toe region, the sole heel region extending longitudinally from the sole heel end to the sole midfoot region, the sole midfoot region extending longitudinally from the sole heel region to the sole forefoot region, the sole forefoot region extending longitudinally from the sole midfoot region to the sole toe region, the sole toe region extending longitudinally from the sole forefoot region to the sole toe end;

the sole comprising a dandelion latex foam material, the dandelion latex foam material comprising dandelion latex and at least one other natural or synthetic polymer.

2. The article of footwear of claim 1, wherein at least 20% of the dandelion latex foam material is a thermoplastic elastomer.

3. The article of footwear of claim 2, wherein the dandelion latex comprises at least 20% of the dandelion latex foam material.

4. The article of footwear of claim 1, wherein at least 50% of the dandelion latex foam material is a thermoplastic elastomer.

5. The article of footwear of claim 1, wherein the sole further comprises a midsole and an outsole, the midsole being between the outsole and the upper, the midsole comprising the dandelion latex foam material.

6. The article of footwear of claim 5, wherein the outsole comprises a dandelion latex non-foam material.

7. The article of footwear of claim 6, wherein the outsole further comprises a dandelion latex foam material.

8. The article of footwear of claim 1 wherein the sole further comprises a midsole and an outsole, the midsole comprising a first dandelion latex foam material, the outsole comprising a second dandelion latex foam material, the first dandelion latex foam material being different from the second dandelion latex foam material.

9. The article of footwear of claim 8 wherein the second dandelion latex foam material is harder than the first dandelion latex foam material.

10. The article of footwear of claim 9 wherein the first dandelion latex foam material has a specific gravity of 0.08 to 0.30 and a hardness of 25 to 90 asker C, and wherein the second dandelion latex foam material has a specific gravity of 0.20 to 0.50 and a hardness of 30 asker C to 75 shore A.

11. The article of footwear of claim 1, wherein the sole comprises an insole, a midsole, and an outsole, the midsole being between the outsole and the insole, the insole comprising the dandelion latex foam material, wherein the dandelion latex foam material constitutes a third dandelion latex foam material, the midsole comprising a first dandelion latex foam material, the outsole comprising a second dandelion latex foam material, the third dandelion latex foam material being different from the first dandelion latex foam material.

12. The article of footwear of claim 11 wherein the second dandelion latex foam material is harder than the first dandelion latex foam material, and the first dandelion latex foam material is harder than the third dandelion latex foam material.

13. The article of footwear of claim 12 wherein the third dandelion latex foam material has a specific gravity of 0.08 to 0.20 and a hardness of 10 to 90 asker C, the first dandelion latex foam material has a specific gravity of 0.10 to 0.30 and a hardness of 30 to 90 asker C, and the second dandelion latex foam material has a specific gravity of 0.20 to 0.50 and a hardness of 35 asker C to 75 shore A.

14. The article of footwear of claim 1 wherein the upper comprises a dandelion latex foam material.

15. The article of footwear of claim 1 wherein the upper comprises a dandelion latex non-foam material.

16. An article of footwear comprising:

a sole; and an upper on the sole;

the sole comprising a midsole and an outsole, the midsole being between the outsole and the upper, the midsole comprising a dandelion latex foam material, wherein the dandelion latex foam material comprises dandelion latex and at least one other natural or synthetic polymer, at least 20% of the dandelion latex foam material being a thermoplastic elastomer.

17. The article of footwear of claim 16, wherein the outsole comprises a dandelion latex non-foam material.

18. The article of footwear of claim 17, wherein the outsole further comprises a dandelion latex foam material.

19. The article of footwear of claim 16, wherein the dandelion latex comprises at least 20% of the dandelion latex foam material.

20. The article of footwear of claim 2, wherein the dandelion latex comprises at least 50% of the dandelion latex foam material.

21. An article of footwear comprising:

a sole comprising an insole, a midsole, and an outsole; and an upper on the sole;

at least one of the upper, insole, midsole, or outsole comprising a dandelion latex foam material, the dandelion latex foam material comprising dandelion latex and at least one other natural or synthetic polymer.

22. The article of footwear of claim 21, wherein the sole is of one-piece unitary construction.

23. The article of footwear of claim 21, wherein the dandelion latex comprises at least 30% of the dandelion latex foam material.

24. The article of footwear of claim 21, wherein the dandelion latex comprises at least 50% of the dandelion latex foam material.

25. The article of footwear of claim 21, wherein the dandelion latex comprises at least 70% of the dandelion latex foam material.

26. The article of footwear of claim 21, wherein at least 10% of the dandelion latex foam material is a thermoplastic elastomer.

27. The article of footwear of claim 21, wherein at least 20% of the dandelion latex foam material is a thermoplastic elastomer.

28. The article of footwear of claim 21, wherein at least 30% of the dandelion latex foam material is a thermoplastic elastomer.

29. The article of footwear of claim 21, wherein the dandelion latex foam material is a cross-linked elastomer.

30. The article of footwear of claim 21, wherein the dandelion latex foam material is a non-cross-linked elastomer.

* * * * *